United States Patent [19]

Bixler et al.

[11] Patent Number: 4,492,331

[45] Date of Patent: Jan. 8, 1985

[54] MULTI-ROW EGG CARTONS

[75] Inventors: Kenneth D. Bixler, Huntington, N.Y.; Richard F. Reifers, New Canaan, Conn.; Henry A. Lord, Cape Elizabeth, Me.

[73] Assignee: Packaging Corporation of America, Evanston, Ill.

[21] Appl. No.: 306,981

[22] Filed: Sep. 29, 1981

[51] Int. Cl.[3] ..... B65D 1/00

[52] U.S. Cl. ..... 229/2.5 EC; 229/44 EC

[58] Field of Search ..... 229/2.5 EC, 44 EC, 45 EC, 229/29 M; 217/26.5

[56] References Cited

U.S. PATENT DOCUMENTS

| | | | |
|---|---|---|---|
| 2,655,305 | 10/1953 | Schilling | 229/44 EC |
| 2,885,136 | 5/1959 | Grant | 229/29 M |
| 2,888,183 | 5/1959 | Reifers | 229/2.5 EC |
| 3,207,409 | 9/1965 | Reifers | 229/2.5 |
| 3,362,605 | 1/1968 | Bixler | 229/2.5 EC |
| 3,558,037 | 1/1971 | Andrews | 229/2.5 EC |
| 3,643,855 | 2/1972 | Donaldson | 229/2.5 EC |
| 3,655,110 | 4/1972 | Eisenbach | 229/44 EC |
| 3,661,317 | 5/1972 | Noguchi | 229/29 M X |
| 3,664,574 | 5/1972 | Pearl | 229/44 EC |
| 3,672,693 | 6/1972 | Weir | 229/2.5 EC |
| 3,749,235 | 7/1973 | Bousier | 229/2.5 EC |
| 3,813,027 | 5/1974 | Misdom | 229/44 EC |
| 4,025,038 | 5/1977 | Reifers | 229/44 EC |
| 4,087,040 | 5/1978 | Bessett | 229/2.5 EC |

FOREIGN PATENT DOCUMENTS

| | | | |
|---|---|---|---|
| 6515947 | 6/1966 | Netherlands | 229/2.5 EC |

*Primary Examiner*—William Price
*Assistant Examiner*—Gary E. Elkins
*Attorney, Agent, or Firm*—Karl W. Flocks; Sheridan Neimark

[57] ABSTRACT

Multi-row, windowed, molded egg cartons each have a relatively shallow cover hinged to a relatively deep tray wherein the cover is provided with a channeled formation in the cover which is reinforced by six ribs and wherein the hinge line between the cover and tray is so located that when the carton is open the top of the cover and the bottom of the tray are in the same plane and the top of the tray is in a plane above bottom of the cover and the cells in the tray each have square bottoms with the sides of the squares arranged at an angle of 45° to the sides of the carton.

14 Claims, 23 Drawing Figures

MULTI-ROW EGG CARTONS

BACKGROUND OF THE INVENTION

This invention relates to new and improved molded egg cartons which may be formed from pulp or plastic foam or the like. More particularly, this invention relates to egg cartons which have specially formed structure in the carton cover to provide a strong load-resistant cover while at the same time making provision for openings or windows through which eggs loaded in the cartons may be viewed. The improved cartons are molded of pulp or foam in open position with the tops of the covers in generally the same plane as the bottoms of the egg cells in the tray portions of the cartons. The egg cells are oriented in a manner different from prior constructions in order to strengthen the cartons and cooperate with other elements in accordance with the invention.

In general, when the cartons are made of molded pulp, they are formed on one side of a shaped screen so that a carton thus formed may be said to have a screen side, which is usually the outside of the carton, and a bark side, which is usually the inside of the carton. In general, when the cartons are made of plastic foam, they are usually thermo-formed or vacuum-formed. In the thermo-forming process and vacuum-forming process a flat sheet of foam is drawn against a shaped mold under the influence of heat and vacuum or heat and pressure.

In the past egg cartons have been made in the configuration of two rows of three eggs, two rows of five eggs, two rows of six eggs and three rows of four eggs. In some instances, a set of threes has been molded as a unit. Egg cartons have been produced both with and without locking flaps. In general, locks on egg cartons include a projection or button formed on either the tray portion or a locking flap associated with the tray and which cooperates with a hole or orifice in the front wall of the cover. In general, cartons are provided with two locks. However, in some instances cartons have been provided with more than two locks.

As shown in U.S. Pat. No. 2,771,233, the master carton designer, Cox, produces a square bottom egg cell which became known as the Case-Ace Egg Cell. The Cox egg cell, in its time, was considered to be the finest egg cell in any egg carton. In Cox's egg cell, the sides of the square on the bottom were parallel to the long front and rear sides of the carton and also parallel to the two short ends of the carton. The lower portion of Cox's egg cell comprise planar sections which extend upwardly and outwardly to merge an arc with an upper conical section. Cox referred to his lower cell wall portions as polygonal and to his upper wall portions as rounded and conical. Cox postulated that his egg cell lower flat surfaces provided effective cushioning and the conical upper portions served to confine the egg therein at its zone of greater girth.

As shown in U.S. Pat. No. 2,990,094, the master carton designer Reifers, in his improved carton which received wide acceptance, adopted the Case-Ace Egg Cell developed by Cox, and included a hinged locking flange provided with buttons or projections which cooperate with holes in the front wall of the cover.

As shown in U.S. Pat. No. 3,362,605, the master carton designer, Bixler, adopted the Case-Ace Egg Cells developed by Cox and the button lock on the locking flange which cooperate with orifices or holes in the front wall of the cover as developed by Reifers. Bixler provides windows in the cover so that the eggs in the carton may be viewed. The U.S. Patents to Bixler, U.S. Pat. Nos. 4,025,038 and 4,059,219 illustrate Bixler's further developments in egg cartons of the type illustrated in his earlier patent, U.S. Pat. No. 3,362,605.

The U.S. Patent to Alsman U.S. Pat. No. 3,217,963, discloses a 2×6 egg carton in which he, too, adopted the Case-Ace Egg Cell developed by Cox. However, Alsman utilized a lock which was different from that of Reifers in that Alsman's carton did not include a locking flap. Alsman provided a locking post which extends upwardly from the front wall of the tray and was adapted to cooperate with an opening in the front wall of the cover.

Friday in his U.S. Pat. No. 3,245,600 discloses a 2×6 egg carton including open ended posts on the front wall of his tray portion which were intended to cooperate with orifices in the front wall of his cover, and, in this regard, Friday endeavored to follow Alsman. The U.S. Patent to Hartmann et al U.S. Pat. No. 3,276,656, illustrates a 2×3 egg carton in which a projection extending upwardly from the tray portion was intended to cooperate with an opening or aperture in the wall of the cover. Hartmann et al generally follows the teaching of Alsman. The U.S. Patent to Seest et al, U.S. Pat. No. 3,471,078, is very similar to Hartmenn et al and discloses a 2×3 egg carton having a domed up post which was intended to cooperate with an opening or orifice in the cover wall. The very top of the dome in the Seest et al patent is provided with a generally horizontal rib. The design of the carton in Seest et al follows Hartmann et al and they both utilize a lock following thee lock design of Alsman.

SUMMARY OF THE INVENTION

In accordance with the invention, windowed egg cartons are provided with two or more longitudinal rows of egg cells with improved structure in both the carton cover and in the carton tray.

It is an object of the invention to provide a molded egg carton in which the bottom of the egg cells are in the same plane as the top of the cover, when the carton is in fully open position which is the position in which the carton is molded.

It is another object to provide an egg carton with a windowed cover, in which the transverse channels between the cover windows are capable of supporting great vertical loads and are of novel construction.

An additional object is to provide the carton cover with structural channels between the windows which channels have high side walls.

A further object is to provide the carton cover transverse structural channels with end walls formed with a central vertical pilaster extending generally vertically from the bottom of the channel to substantially the top of the cover.

Another object is to provide upwardly extending raised cell junctions about the perimeter of the cellular tray adjacent the ends and front and rear sides thereof. These raised cell junctions guide and separate eggs during the automatic loading of the carton and serve to assist the centering of the cover during the automatic closing of the cover after the eggs are loaded in the carton and cooperate with the mating of the down-posts in the cover with up-posts in the tray.

It is another object to improve the cell construction whereby the walls forming the up-posts, on their inner side may be provided with inwardly extending cushioning pads at an upper elevation of the egg cells, and, said up-posts, on their outer sides may be provided with thin areas at a lower elevation, and the cell bottoms may be provided thin areas and solid downwardly projecting foot structure.

It is still another object to produce a multi-row egg carton which will have a minimum projected area of the open cartons in the molding orientation.

A further object of the instant invention is to provide egg cartons utilizing the accepted square bottom egg cell in a new orientation.

Another object is to provide an egg carton having a cellular tray including square bottom cells in which the sides of the square are at an angle of about 45° to the ends and front and rear sides of the carton. This orientation of the cells strengthens the carton particularly in a transverse direction and, at the same time, provides a longer area of support to receive vertical stress when the loaded cartons are stocked one over the other. This orientation also provides a lower bridge connection between the locking projection on the front wall of the tray and the up-post which is in transverse alignment with it, so that it may more readily flex inwardly as required during the automatic locking operation.

A still further object is to improve the stack strength of cartons having three longitudinal rows by forming the end walls of the cover with load-bearing indentations closer to the cover front wall than to the cover rear wall which indentations cooperate with structure in the corresponding location on the cellular tray.

Another object is to improve the stack strength of multi-row cartons by forming the central portions of front and rear cover walls with load-bearing indentations which extend downwardly from the top of the cover to a location short of the bottom of the cover, which indentations have a shoulder which abuts a corresponding upwardly extending formation in the tray, when the carton is closed.

It is an object of the instant invention to provide a molded egg carton having three longitudinal rows of six egg cells in its tray portion and twelve windows in its cover portion which expose at least a portion of each of the eighteen eggs therein.

DETAILED DESCRIPTION OF THE INVENTION

Figure 1:
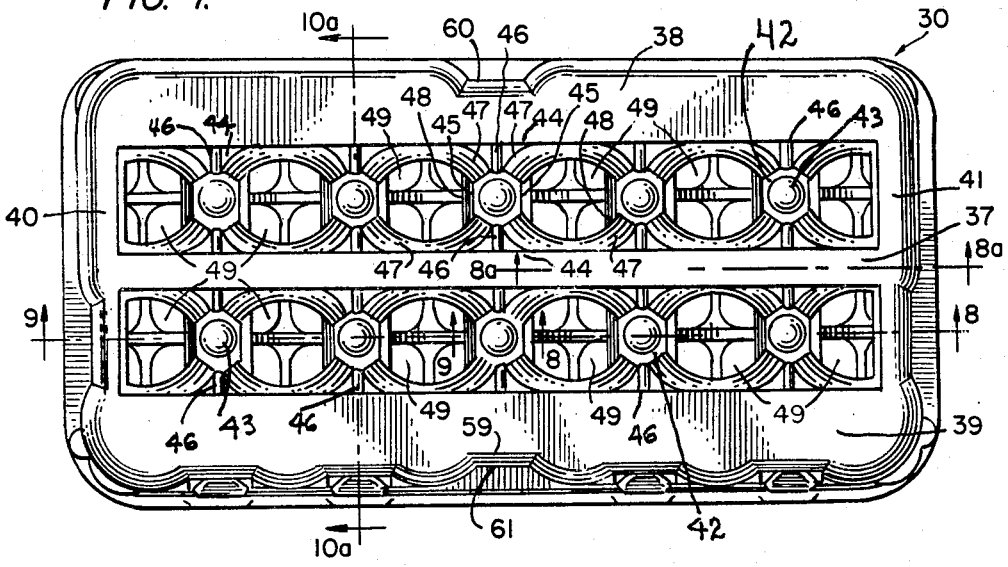
FIG. 1 is a plan view of a molded egg carton in accordance with one form of our invention.

Referring to the drawings, FIGS. 1 to 4, 4*a*, 5, 6 to 8, 8*a*, 9, 10 and 10*a* illustrate one embodiment of the invention in the form of a 3×6 egg carton. FIGS. 11 to 20 illustrate a second embodiment of the invention in the form of a 2×6 egg carton.

Referring to FIGS. 1 to 4, 4*a*, and 9, the egg carton 30 comprises a cover 31, a cellular tray 32 connected to the cover by a hinge 33 and a latching or lock formation 34 on the tray which cooperates with opening or orifice 35 in the cover.

The top 36 of the cover 31 includes a longitudinal center rail 37, a longitudinal rear rail 38, a longitudinal front rail 39, and two transversely extending end rails 40 and 41. The longitudinal rails are spaced transversely from each other. The end rails are formed integral with the ends of said longitudinal rails.

A windowed structure 42 is formed between the center rail 37 and the rear rail 38. A similar windowed structure 42 is formed between the center rail 37 and the front rail 39. The windowed structures 42 include a first interengaging formation in the shape of a dome 43 located below the level of the longitudinal rails 37, 38, 39 and is surrounded by two channel end walls 44, 44 and two channel side walls 45, 45 and reinforced by six ribs. Two of said ribs are pilaster ribs 46, 46 which extend from adjacent the periphery of the first interengaging formation or from the lowermost part of the circumference or base of the dome 43 upwardly and outwardly to two of the longitudinal rails. Four of said six ribs are eyebrow ribs 47, 47, 47, 47 which extend from adjacent the periphery of the first interengaging formation or from the lowermost part of the circumference or base of the dome 43 upwardly and outwardly to two of the longitudinal rails and in a direction away from the two pilaster ribs 46 toward two of the longitudinal rails. The eyebrow ribs 47 separate and define margins of said channel end walls 44 and said channel side walls 45. The uppermost margins 48 form a margin portion of windows 49 in the top 36 of the carton cover 31. The channel side walls 45 are at least 40% of the vertical height of the pilaster ribs 46 which extend to substantially the full height of the channel end walls 44, 44 and from the periphery of the base of the first interengaging formation or dome 43 to the top 36 of the cover 31.

The windowed structure 42 is made up of a series of elements including the high channel side walls 45 and the end walls 44 provided with pilaster ribs 46 from which the eyebrow ribs 47 extend away, which series of elements cooperate with each other and with the longitudinal rails in the top 36 of the cover 31 to provide great support under such loads which occur, for example, when cartons 30 filled with eggs are stacked one upon another.

Figure 2:
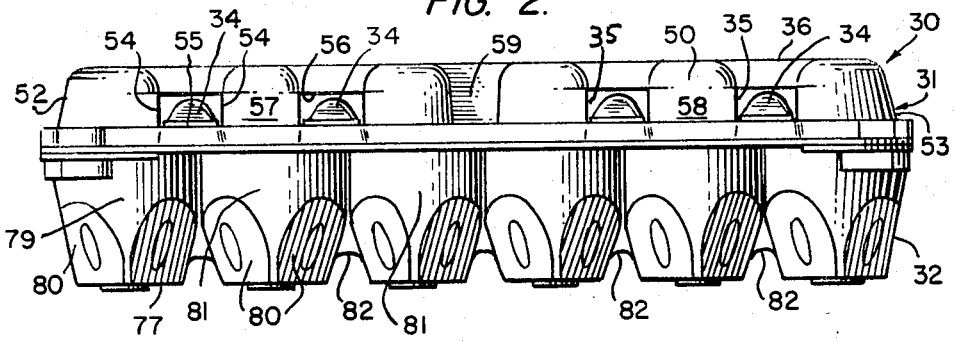
FIG. 2 is a front elevation thereof.
Figure 3:
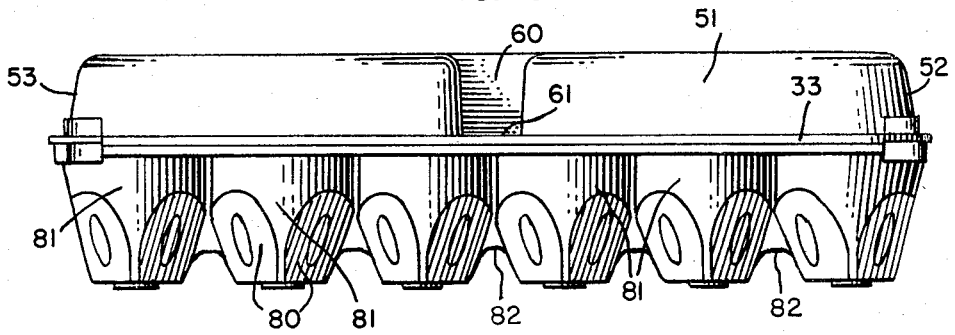
FIG. 3 is a rear elevation thereof.
Figure 4:
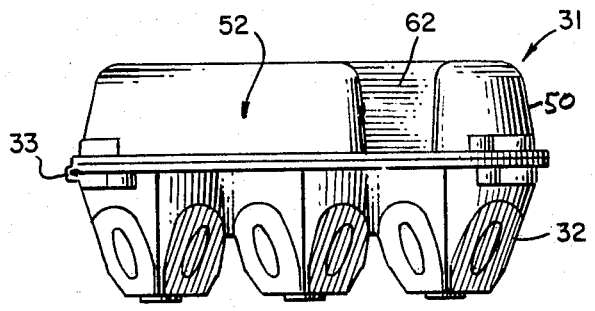
FIG. 4 is an end elevation thereof taken from the left end.
Figure 4A:
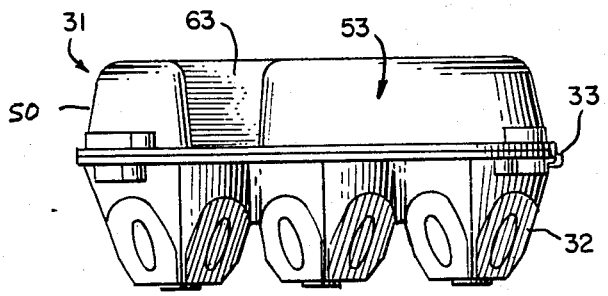
FIG. 4*a* is an end elevation thereof taken from the right end.
Figure 7:
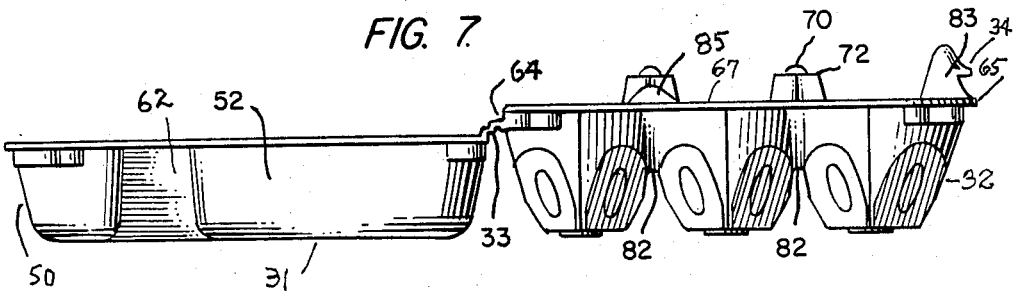
FIG. 7 is an end elevation of open carton illustrated in FIG. 1 taken from the left side of the carton.
Figure 8:
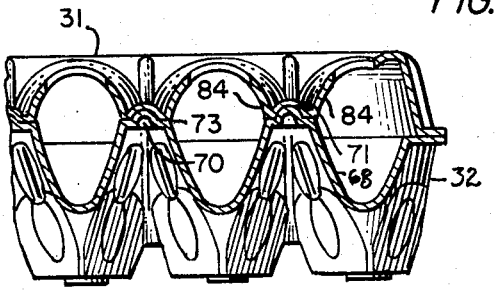
FIG. 8 is a longitudinal vertical section through the up-posts in the right half of the carton taken along line 8—8 on FIG. 1 and looking in the direction of the arrows.

A longitudinal front wall 50 extends downwardly from the front rail 39 of the top 36 of the cover 31. A longitudinal rear wall 51 extends downwardly from the rear rail 38. End walls 52, 53 extend downwardly from end rails 40, 41. The rear wall 51 of the cover 31 has a greater vertical dimension than the vertical dimension of the cover front wall 50 and a greater vertical dimension than the cover end walls 52 and 53. The cover front wall 50 is formed with one or more openings or orifices 35. Preferably in a 3×6 carton 30, four openings 35 are provided. Each opening 35 has two side margins 54 and a bottom margin 55 in substantially the same plane. The upper margin 56 of each opening 35 is recessed inwardly. When four openings 35 are formed in the carton 30, as illustrated in FIG. 2, a planar wall portion 57 extends between the first and second openings 35 and a planar wall portion 58 extends between the third and fourth openings 35. A recessed front wall portion 59 is located between said second and third openings 35 and is generally centrally located on the front wall 50 of the carton cover 31. This front wall recess 59 extends inwardly more than the recess of the upper margin 56 of openings 35. A generally vertical recessed wall portion 60 in said cover rear wall 51 extends from the top 36 of the cover 31 downwardly for a dimension equal to the height of the front wall 50 to a shoulder portion 61 above the bottom of said rear wall 51. The end walls 52 and 53 each have generally vertical recesses 62, 63 closer to the front wall 50 than to the rear wall 51. Recesses 62 and 63 are located in the area below the space between the center rail 37 and the front rail 39.

Referring to FIGS. 5, 6, 7, 8, 8*a*, 10 and 10*a*, the molded egg carton 30 includes a cover 31 and cellular tray 32 hingedly connected at 33 to bottom margin of the lowermost portion of the cover rear wall 51 and to the rear wall 64 of the tray 32. The cellular tray 32 has a rear wall 64, a front wall 65 and two end walls 66, 67. The top of the tray rear wall 64 is below the level of the top of the tray front wall 65 and the top of the tray end walls 66,67. The height of the tray 32 at the location of the front wall 65 and the two tray end walls 66,67 plus the height of the cover front wall 50 is equal to the total height of the carton 30 when closed.

The cellular tray 32 is provided with at least two longitudinal rows of upstanding posts or up-posts 68. The top 69 of each of said upstanding posts, including a second interengaging formation 70 for cooperation with the underside of the first interengaging formation or dome 43 on said cover 31.

The underside of the first interengaging formation or dome 43 is in the form of an inverted crater 71. The second interengaging formation 70 or dome is in the shape of a corresponding dome 70 surrounded by a peripheral shelf 72 so that the dome 70 fits into the inverted crater 71 and the peripheral shelf 72 cooperates with the corresponding rim 73 of the inverted crater.

Figure 5:
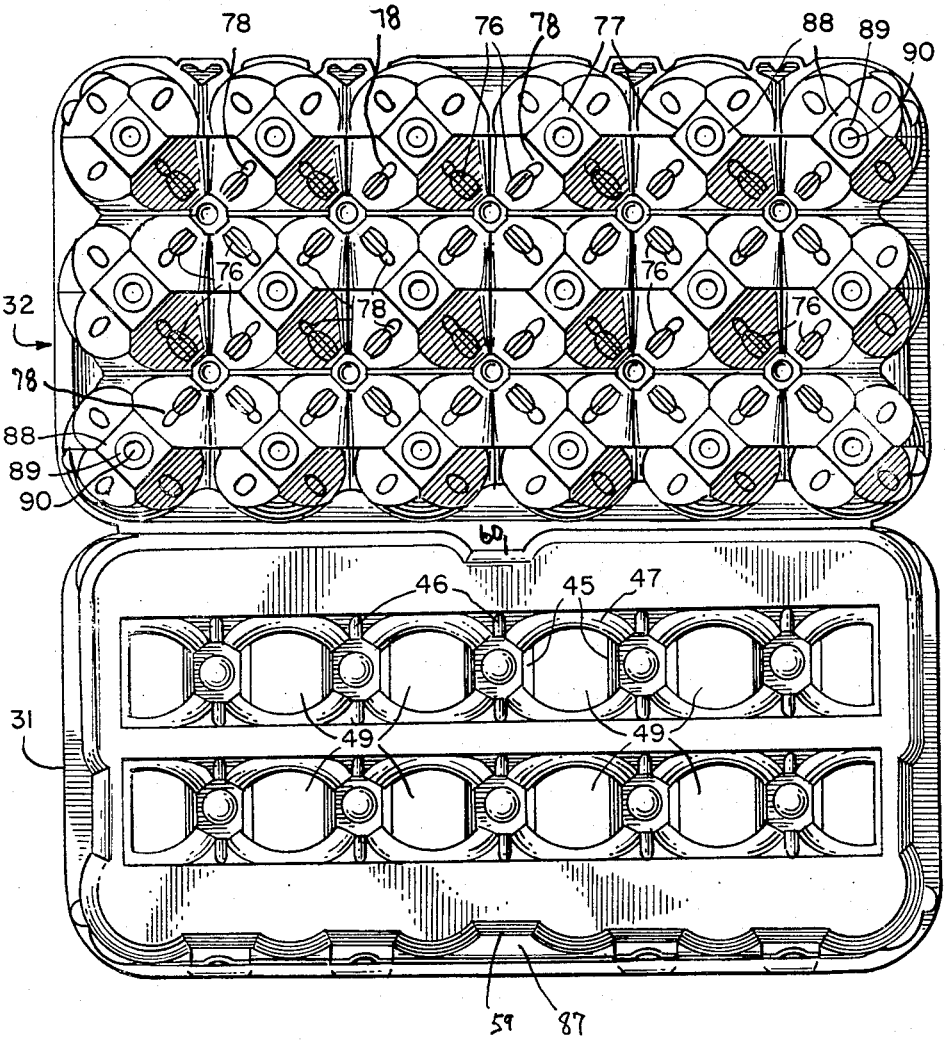
FIG. 5 is a plan view of the open carton illustrated in FIG. 1 and showing the outside of the carton top or cover and the outside of the carton bottom or cellular tray.
Figure 6:
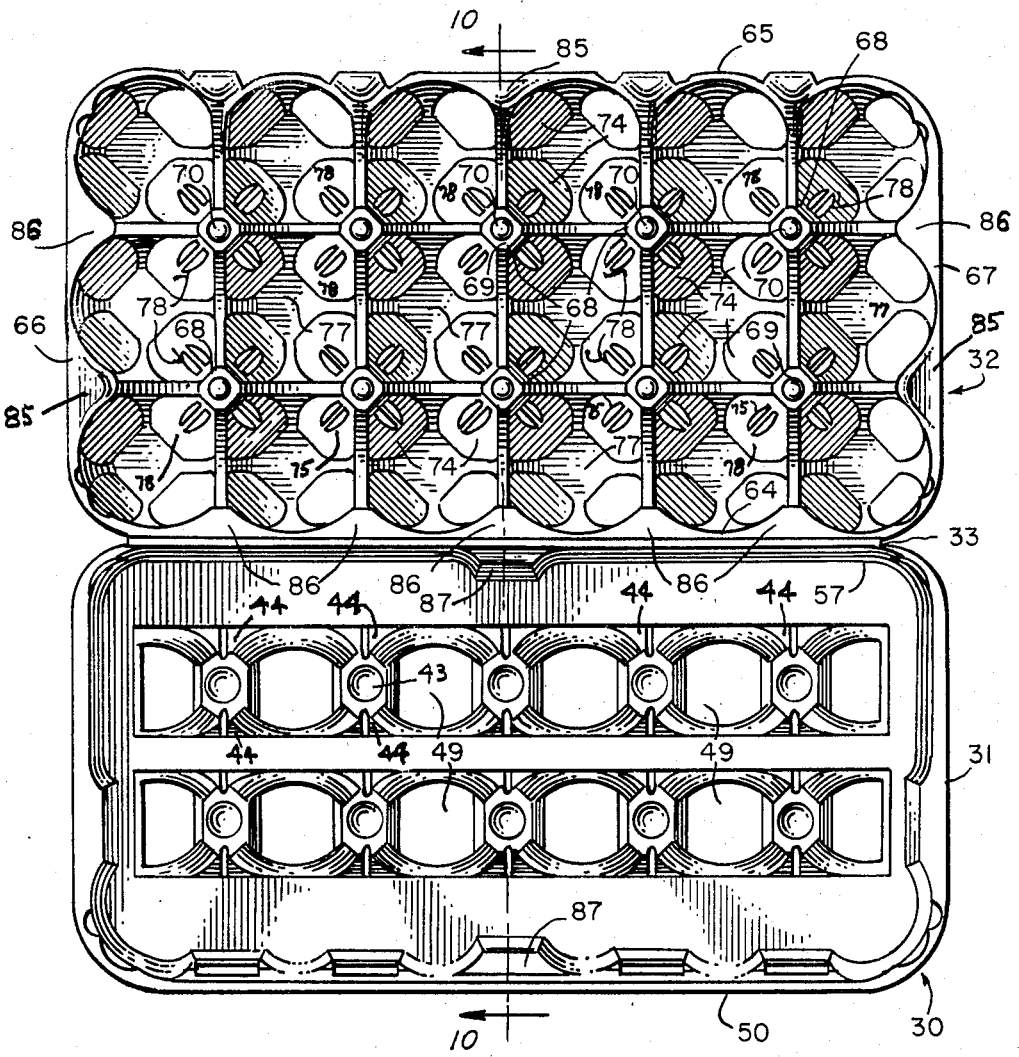
FIG. 6 is a plan view of the open carton illustrated in FIG. 1 and showing inside of carton bottom or cellular tray and the inside of the carton top or cover.
Figure 8A:
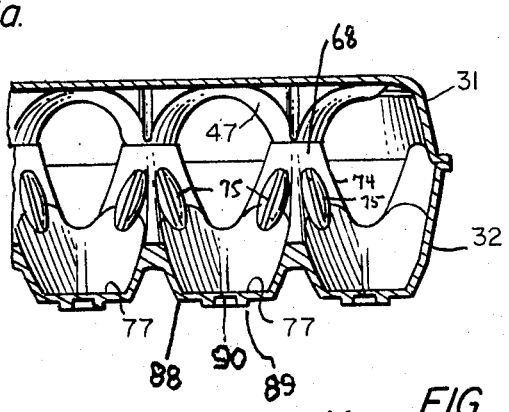
FIG. 8*a* is a longitudinal vertical section in the right half of the carton taken along line 8*a*—8*a* on FIG. 1 and looking in the direction of the arrows.
Figure 9:
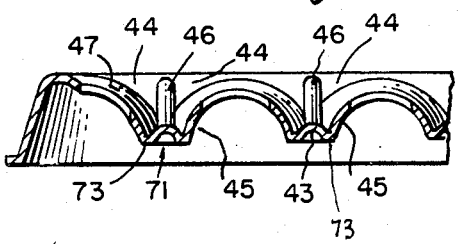
FIG. 9 is a longitudinal vertical section through the center of the down-posts on the left half of the carton cover taken along line 9—9 on FIG. 1 and looking in the direction of the arrows.
Figure 10:
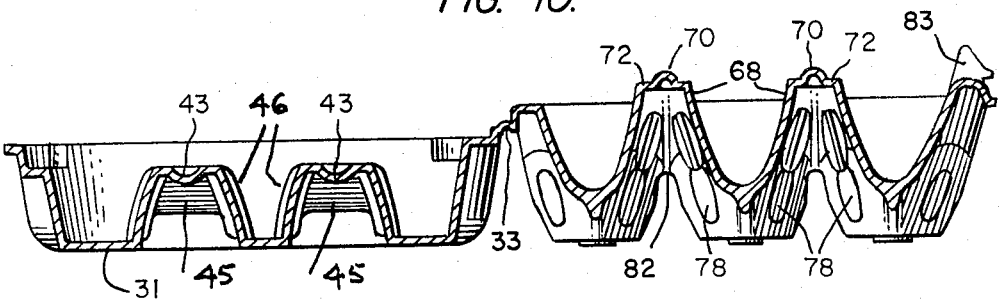
FIG. 10 is a transverse vertical section through the transverse center of the open carton shown in plan view in FIG. 6, taken along line 10—10 on FIG. 6 and looking in the direction of the arrows.
Figure 10A:
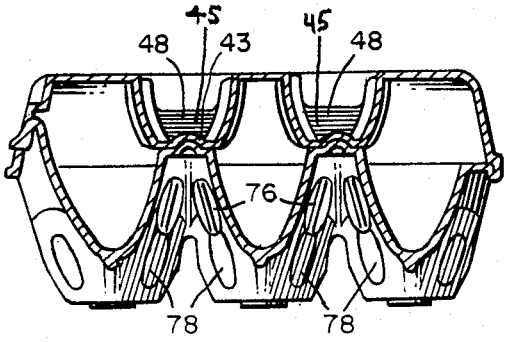
FIG. 10*a* is a transverse vertical section through the center of locking button and the up-posts on the carton cover taken along line 10*a*—10*a* on FIG. 1 and looking in the direction of the arrows.
Figure 11:
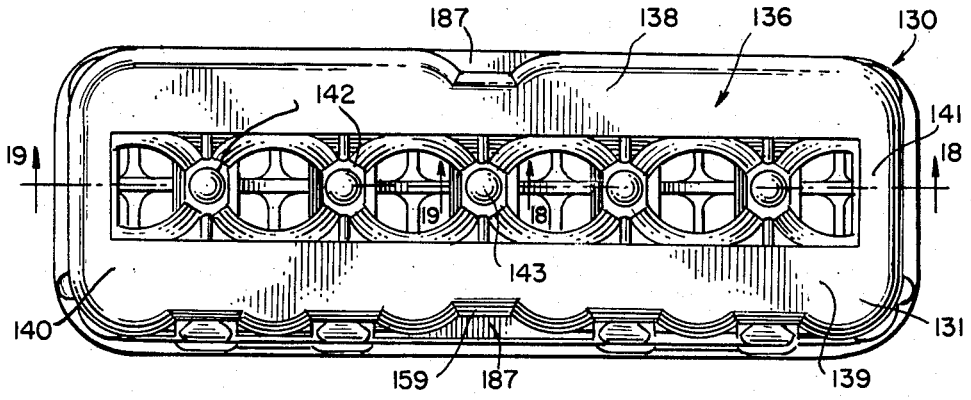
FIG. 11 is a plan view of the molded egg carton illustrating another embodiment.

Each of the up-posts 68 have side walls 74 formed with four outwardly projecting portions 75 corresponding to the four indentations 76 on the underside of the side walls of said posts, as illustrated in FIG. 5. The generally vertical axis of each of said projections 75, as they appear in FIG. 6, are spaced from each other by an angle of approximately 90° and are located above a cellular or cell bottom 77 of generally square configuration with each side of the square arranged at an angle of approximately 45° to the tray side wall 64, 65 and tray end walls 66 and 67. The walls 78 of the egg cells below the projections 75 which extend inwardly from the posts 68 and adjacent the egg cell bottoms 77 are thinner than the remainder of the walls of the egg cells.

Referring specifically to FIG. 6, there are four egg cells grouped about each up-post 68, and there are four convex formations 75 on the upper portion of each up-post 68. Each one of the four formations 75 on the up-post 68 extends into one of the four cells grouped about the up-post 68. The wall thickness of the convex formation 75 is less than the wall thickness of the main body of each of the egg cells. Each of the egg cells has a second defined thin portion 78 adjacent the cell bottom 77. This thin portion 78 is illustrated in FIG. 5 which shows the outside or underside of the egg cells and the thin portion 78 is not apparent on the inside of the egg cells which are illustrated in FIG. 6. However, the location of the thin portions 78 is below the convex formations 75 which are illustrated in FIG. 6.

Each of the egg cells 79 of the cellular tray 32 includes a square bottom 77 and four upwardly and outwardly extending planar portions 80 which merge with an upper generally conical section 81 in such fashion that at the corners of the bottom of each egg cell, the conical section 81 is located between the sides of the planar portions 80. The egg cells 79 are located so close together that they merge at 82, with each other, at the conical sections 81 below a plane parallel to the bottoms of the egg cells which passes through the uppermost points of the planar portions. This relatively low level of merge which increases the strength of the cellular tray 32 of the carton 30 is made possible by orienting the square bottoms 77 of the cells so that the sides of the squares are at an angle of 45° to the sides and ends of the carton. This low merging connection 82 facilitates and enhances the essential flexing of the latching or lock formations 83 which extend upwardly between two adjacent perimeter egg cells on the front wall 65 of the cellular tray 32. Thus, the cutting of the merger connection in order to permit essential flexing of the latching or lock formation 83, which would otherwise be necessary, is advantageously avoided.

Not only does the carton 30 have downposts 84 in the cover 31 which cooperate with up-posts 68 in the cellular tray 32, but the tray is further provided with an upstanding perimeter post 85 on the front wall 65 of the tray 32 and an upstanding perimeter post 85 on each of the tray end walls 66 and 67. These upstanding perimenter posts 85 which occur at the location of cell junctions extend higher than the peripheral margin of the tray 32. The cell junctions 86 along the rear wall 64 of the cellular tray 32 extend higher than the hinged connection 33 and into the cover 31 of the tray 32.

The recessed front wall portion 59 on the cover extends downwardly to a shoulder 87 and is adapted to engage the perimeter up-post 85 on the tray front wall 65. The generally vertical recessed portion 60 in the cover rear wall 51 extends downwardly to a shoulder 87 adapted to engage the top of a perimeter cell junction 86 along the rear wall of the tray 32 when the carton 30 is closed. The top of the perimeter cell junction 86 which is higher than the hinged connection 33 when the carton is in open position, as illustrated in FIG. 6, is adapted to engage the shoulder 87 on the tray 32 when the carton is closed.

The egg carton 30 is not only of strong construction in both transverse and longitudinal directions, but the formations incorporated therein to enhance its strength also serve to facilitate the automatic loading of eggs in the carton when the carton is open and facilitate the alignment of the carton during the automatic closing and locking of the cover to the tray.

Each cell 79 of the cellular tray 32 is substantially flat on its interior bottom and footed on its exterior, as illustrated in FIG. 5. The footed exterior of the tray includes a peripheral thin area 88 within which is enclosed a thick portion 89 of closed geometrical form. This thick portion 89 is arranged about a thin central portion 90. As the cell bottom is flat on its interior, and has thick and thin portions on its exterior, the egg cell is supported in such fashion that some of the area of the cell bottom may flex to accommodate an egg therein. The fitted formation cooperates with the egg carton so that when the egg cartons are stacked, after they are loaded, they are structurally arranged to resist vertical stresses. With the egg cell bottom oriented, as illustrated in FIG. 5, the longitudinal dimension from the outside of the bottom of the first cell in a row to the outside of the bottom of the last cell in a row is greater than the longitudinal dimension of the same number of egg cells having square bottoms which are not oriented, as illustrated in FIG. 5, but are so oriented that the sides of the square bottoms are parallel to the sides and ends of the carton. This longer longitudinal dimension significantly enhances the carton's resistance to stresses when loaded and stacked.

The multi-row egg carton illustrated in FIGS. 1–4, **4*a*, 4–8, 8*a*, 9, 10 and 10*a*** is provided with a cover having a number of windows equal to two-thirds the number of egg cells and wherein each window is adapted to permit viewing of portions of more than one egg. This carton, as illustrated, has three rows of six cells for the accommodation of eighteen eggs and its cover has twelve windows.

The carton, as above described, which includes a cover hinged to a tray and a locking or latching formation is exceptionally strong, attractive and of significant utility. While providing strength, significantly the size of the carton or its vertical projected area has been kept to a minimum so that it may be accommodated by the egg packer to egg packing machinery and to super packages which contain quantities of egg cartons and to the super market display counters and shelves.

Referring to FIGS. 11–20 which illustrate a second embodiment of the invention in the form of a 2×6 egg carton which has many features in common with the 3×6 egg carton described in connection with FIGS. 1–4, **4*a*, 5–8, 8*a*, 9, 10 and 10*a*, the carton 130 includes a cover 131, a cellular tray 132 connected to the cover by a hinge 133 and a latching and lock formation 134 which cooperates with the opening or orifice 135** in the cover.

The top 136 of the cover 131 includes a longitudinal rear rail 138, a longitudinal front rail 139 and two transversely extending end rails 140 and 141. The longitudinal rails are spaced transversely from each other. The end rails are formed integral with the ends of said longitudinal rails.

A windowed structure 142 is formed between the rear rail 138 and the front rail 139. The windowed structure or structures 142 include the same formation and structure described in connection with the 3×6 egg carton already described.

Figure 12:
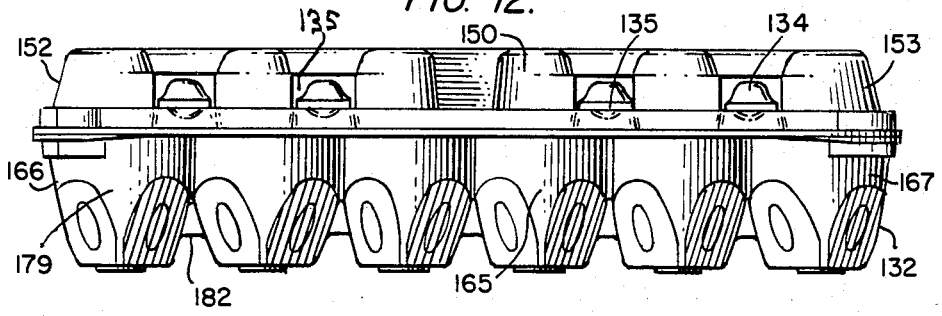
FIG. 12 is a front elevation thereof.
Figure 13:
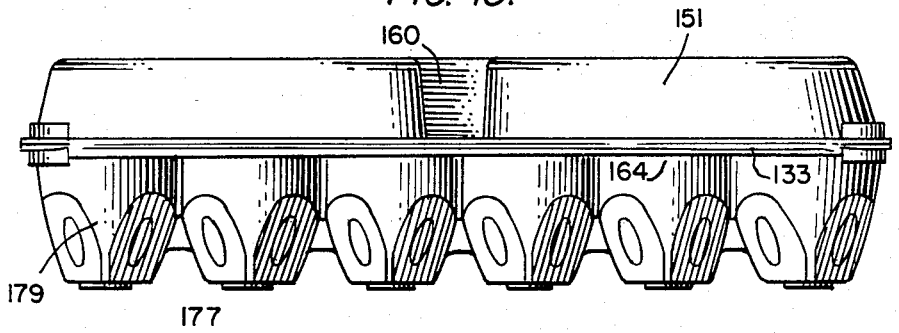
FIG. 13 is a rear elevation thereof.
Figure 14:
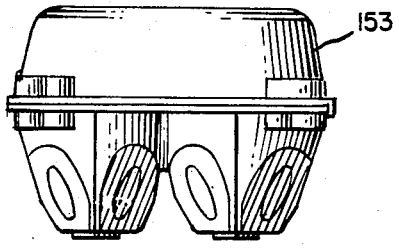
FIG. 14 is an end elevation taken from the right end.

A longitudinal cover front wall 150 extends downwardly from the front rail 139 of the top 136 of the cover 131. A longitudinal cover rear wall 151 extends downwardly from the rear rail 138. End walls 152 and 153 extend downwardly from the end rails 140, 141. The rear wall 151 of the cover 131 has a greater vertical dimension than the vertical dimension of the cover front wall 150 and a greater vertical dimension than the cover end walls 152 and 153. The cover front wall 150 is formed with one or more openings or orifices 135. The 2×6 carton is illustrated as having four openings 135, but it may be arranged to have two openings with the first opening occurring in the location over the junction of the second and third front egg cells in the front row and the second opening may be located over the junction between the fourth and fifth egg cells in the front row. When four openings 135 were formed in the carton 130, as illustrated in FIG. 12, the construction of the front wall 150 is similar to the front wall 50 described in connection with the 3×6 carton.

Referring to FIGS. 15, 16, 17, 18 and 20, the molded egg carton 130 includes a cover 131 and a cellular tray 132 hingedly connected at 133 to the bottom margin of the lowermost portion of the cover wall 151 and to the rear wall 164 of the tray 132. The cellular tray 132 has a rear wall 164, a front wall 165 and two tray end walls 166 and 167. The top of the tray rear wall 164 is below the top of the tray front wall 165 and the top of the tray end walls 166 and 167. The height of the tray 132 at the location of the front wall 165 and the two tray end walls 166 and 167 plus the height of the cover front wall 150 is equal to the total height of the carton 130 when closed.

The cellular tray 132 is provided with one longitudinal row of upstanding posts or up-posts 168. The top 169 of each of said upstanding posts includes a second interengaging formation 170 for cooperation with the underside of the first interengaging formation or dome 143 on said cover 131. The cooperation of the first interengaging formation or dome 143 with the second interengaging formation 170 is similar to the corresponding structure described in connection with the 3×6 egg carton.

Figure 15:
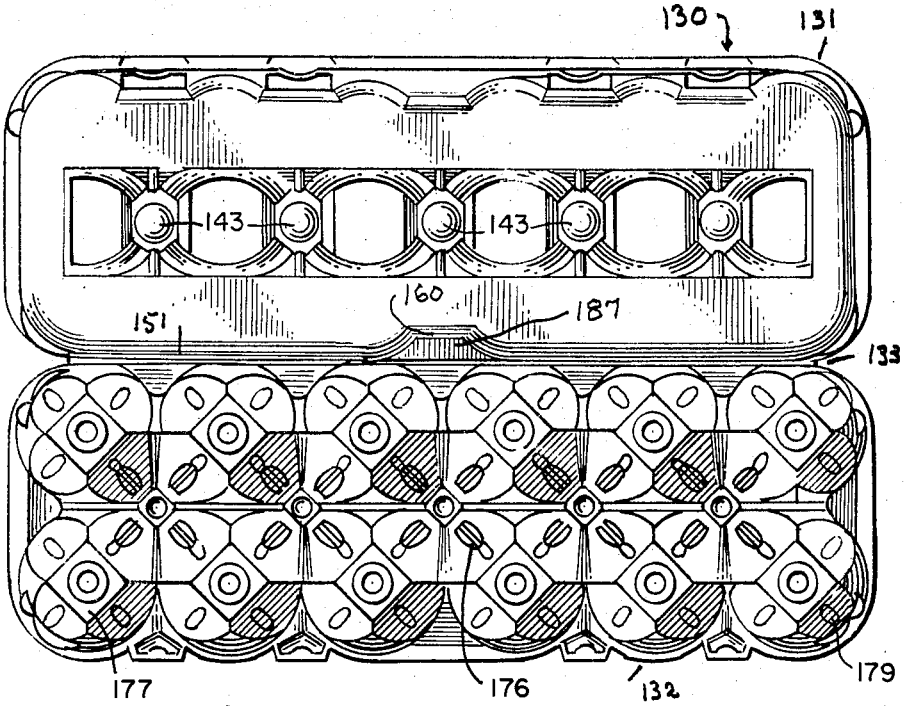
FIG. 15 is a plan view of the open carton illustrated in FIG. 11 showing the outside of the carton top or cover and the outside of the carton bottom or cellular tray.

Each of the up-posts 168 have side walls 174 formed with four outwardly projecting portions 175 corresponding to the four indentations 176 on the underside of the side walls of said posts, as illustrated in FIG. 15. The structure and arrangement of the projecting portions 175 which extend outwardly from the posts and inwardly toward the central vertical axis to the egg cell are similar to the projection portions 75 as described in connection with the 3×6 carton of the first embodiment.

Each of the egg cells 179 of the cellular tray 132 includes a square bottom 177 and upwardly and outwardly extending four planar portions similar to that described in connection with the egg cells 79 of the 3×6 carton of the first embodiment. The merging of the egg cells 179 at 182 is similar to the merging of the egg cells 79 and 80, as described in connection with the 3×6 carton. This low merging connection 182 facilitates and enhances the essential flexing of the latching or lock formations 183 and extends upwardly between two adjacent perimeter egg cells on the front wall 165 of the cellular tray 132. Thus, the cutting of the merging connection in order to permit essential flexing of the latching or lock formation 183, which would otherwise be necessary, is advantageously avoided. Not only does the carton 130 have down-posts 184 in the cover 131 which cooperate with the up-posts 168 in the cellular tray 132, but the tray 132 is further provided with an upstanding perimeter post 185 on the front wall 165 of the tray 132 and an upstanding perimeter post 185 on each of the tray end walls 166 and 167. These upstanding perimeter posts 185 which occur at the location of cell junctions extend higher than the peripheral margin of the tray 132. The cell junctions 186 along the rear wall 164 of the cellular tray 132 extend higher than the hinged connection 133 and into the cover 131 of the tray 132.

Figure 16:
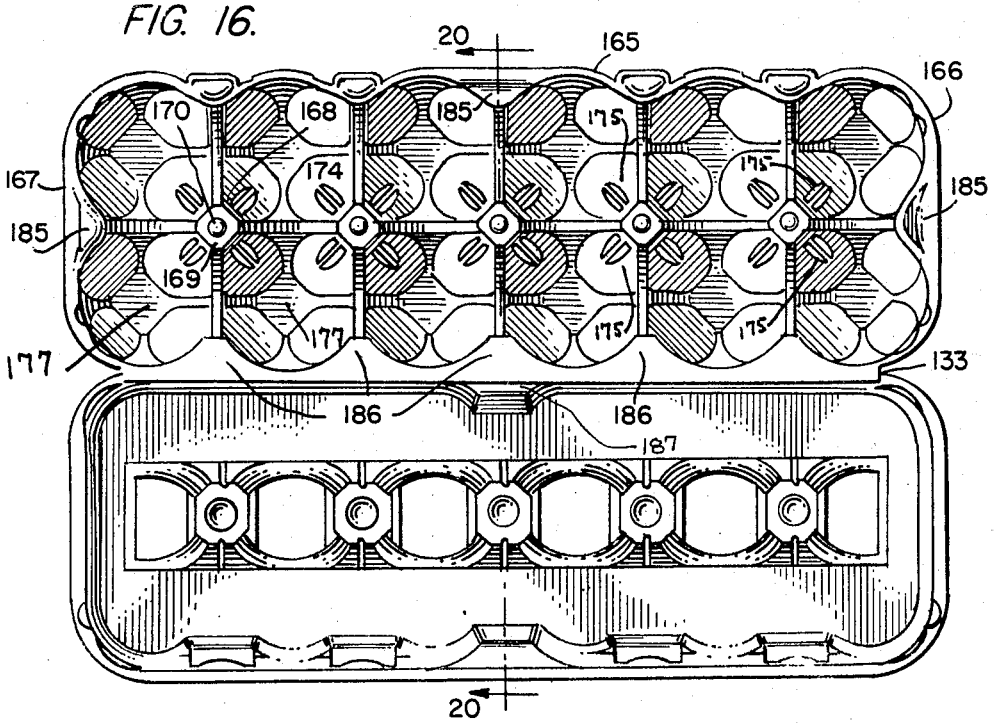
FIG. 16 is a plan view of the open carton illustrated in FIG. 11 showing inside of carton bottom or cellular tray and the inside of the carton top or cover.
Figure 17:
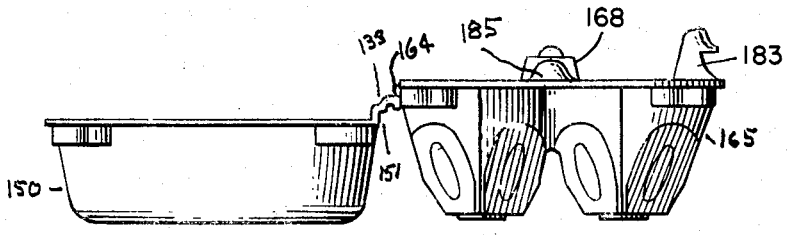
FIG. 17 is an end elevation of open carton taken from the left side of the carton shown in FIG. 11.
Figure 18:
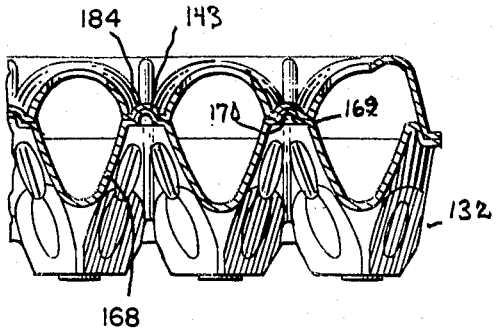
FIG. 18 is a longitudinal vertical section through the right half of the carton shown in plan in FIG. 11 taken along line 18—18 on FIG. 11 and looking in the direction of the arrows.
Figure 19:
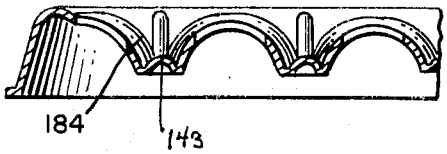
FIG. 19 is a longitudinal vertical section through the left half of the carton cover shown in plan in FIG. 11, taken along line 19—19 on FIG. 11 and looking in the direction of the arrows.
Figure 20:
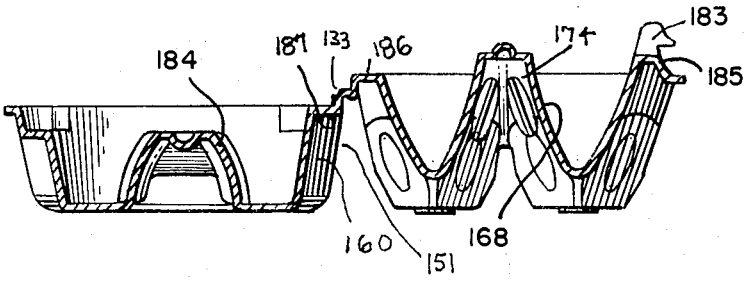
FIG. 20 is a transverse vertical section through the transverse center of the open carton shown in plan view of FIG. 16, taken along line 20—20 in FIG. 16 and looking in the direction of the arrows.

The recessed front wall portion 159 on the cover 131 extends downwardly to a shoulder 187 and is adapted to engage the perimeter up-posts 185 on the tray front wall 165. The generally vertical recessed portion 160 in the cover rear wall 151 extends downwardly to a shoulder 187 adapted to engage the top of a perimeter cell junction 186 along the rear wall of the tray 132 when the carton 130 is closed. The top of the perimeter cell junction 186 which is higher than the hinged connection 133 when the carton is in open position, as illustrated in FIG. 16, is adapted to engage the shoulder 187 on the tray 132 when the carton is closed.

As described in connection with the egg carton 30, the egg carton 130 is not only of strong construction, but the formations incorporated therein to enhance its strength serve to facilitate the automatic loading of eggs in the carton when the carton is open and facilitate the alignment of the carton during the automatic closing and locking of the cover to the tray.

Each cell 179 of the cellular tray 132 is substantially flat on its interior bottom and footed on its exterior, as illustrated in FIG. 15 and described in connection with the first embodiment, the 3×6 carton. However, the footed exterior of the cell bottoms of the tray 132 may be modified so that the square bottom on its exterior may be of the same thickness as the remainder of the cell body with the exception of a central portion of closed geometrical form having an area thinner than the remainder of the wall thickness of the cell body.

The square bottoms of the egg cells described in connection with this 2×6 carton 130 are so oriented that the sides of the squares are arranged at a 45° angle to the sides and ends of the carton 130 to effect a longer longitudinal dimension of support when the cartons are stacked and so to enhance the cartons' resistance to stress when loaded and stacked.

As described in connection with the 3×6 carton 30, the 2×6 carton 130 is windowed to permit viewing of the eggs, is exceptionally strong, attractive and of significant utility.

It will be obvious to those skilled in the art that various changes may be made without departing from the scope of the invention and the invention is not to be considered limited to what is shown in the drawings and described in the specifications.

What is claimed is:

1. In a windowed egg carton having at least two rows of egg cells, a cellular tray having a longitudinal row of upstanding posts, a carton cover hingedly connected to said cellular tray and including at least two sets of spaced rails with one set arranged at right angles to the other set with a windowed structure formed between at least one set, said windowed structure including a plurality of openings, at least two interengaging formations located below the level of said rails and supported on top portions of a corresponding number of said upstanding posts, channel walls with vertical pilaster ribs extending upwardly and outwardly from opposite sides of the periphery of said interengaging formation to one of said sets of spaced rails forming a strengthened structure supporting said rails on said upstanding posts under vertical loading, at least one of said pilaster ribs being disposed within a plane extending substantially transversely of the row of posts formed in said tray and intersecting a post of said row.

2. The structure recited in claim 1, wherein a male latching formation is upstanding from the front side of said tray which is a side opposite from the side at which said cover and said tray are hingedly connected, a corresponding orifice located in said cover to receive said male latching formation therein.

3. The structure recited in claim 1, wherein each cell of said cellular tray includes a square bottom having four upwardly and outwardly extending planar portions which merge with an upper generally conical section in such fashion that at the corners of the bottom of each cell said conical section is located between the sides of said planar portions, the egg cells being located so close together that they merge with each other at said conical section at points below the uppermost points of said planar portions, and wherein the cells are so arranged that the sides of the bottom of the cell are at an angle of 45° to a side of the carton.

4. The structure recited in claim 1, wherein four egg cells are grouped about each of said upstanding posts, four convex formations are formed on an upper portion of each of said upstanding posts, one of each of said formations extending into each of said egg cells, the wall thickness of said convex formations being less than the wall thickness of the main body of each of said egg cells.

5. The structure recited in claim 4, wherein each of said egg cells has a second defined thin portion below said convex formation.

6. The structure recited in claim 1, wherein said tray is further provided with upstanding perimeter posts along its peripheral walls at the location of junctions of said cells which extend higher than a peripheral margin of said tray.

7. The structure recited in claim 6, wherein said upstanding perimeter posts along the wall of said tray are higher than the hinged connection between said cover and said tray.

8. The structure recited in claim 6, wherein a front wall of said cover is provided with an indentation extending downwardly from the top of said cover to a shoulder above the bottom of said cover, said shoulder being adapted to engage said perimeter upstanding post on a front wall of said tray.

9. In a windowed egg carton having more than two longitudinal rows of egg cells, a carton cover characterized by a top having a longitudinal center rail, a longitudinal rear rail and a longitudinal front rail and two end rails, said longitudinal rails being spaced transversely from each other and said end rails being formed integral with the ends of said longitudinal rails, a windowed structure formed between said center rail and said rear rail, a windowed structure formed between said center rail and said front rail, said windowed structures including a dome located below the level of said longitudinal rails and surrounded by two channel end walls, two channel side walls and reinforced by six ribs, two of said ribs being pilaster ribs extending from the lowermost part of the circumference of said dome upwardly and outwardly to two of said longitudinal rails, four of said ribs being eyebrow ribs and extending from the lowermost part of the circumference of said dome and upwardly and outwardly and in a direction away from said pilaster ribs toward two of said longitudinal rails and separating and defining the margins of said channel end walls and said channel side walls, the uppermost margins of said channel side walls forming a margin portion of windows in said carton cover, said uppermost margins of said channel side walls being located at an elevation of at least 40% of the vertical height of said pilaster ribs which extend from below the top of said dome to the top of said cover.

10. In a windowed egg carton having at least two rows of egg cells, a carton cover including a top having at least two sets of spaced rails and one set being arranged at right angles to another set, a windowed structure formed between at least one set, said windowed structure having a first interengaging formation located below the level of said one set of rails and surrounded by a channel having two side walls and two end walls, said windowed structure being reinforced by six ribs, two of said ribs being generally vertical pilaster ribs extending from the level corresponding to the periphery of said interengaging formation in a direction upwardly and outwardly to one set of rails, four of said ribs being eyebrow ribs and extending from adjacent the periphery of said interengaging formation upwardly and outwardly along an arc away from said pilaster ribs toward said one set of rails and separating and defining margins of said channel end walls and said channel side walls, the uppermost margins of said channel side walls forming a margin portion of windows in said carton cover, said uppermost margins of said channel side walls being located at an elevation of at least 40% of the vertical height of said pilaster ribs.

11. The structure recited in claim 10, said carton including a cellular tray having at least two longitudinal rows of upstanding posts, the top of each of said upstanding posts including a second interengaging formation for cooperation with the underside of the interengaging formation on said cover.

12. The structure recited in claim 11, wherein said first interengaging formation is a dome the underside of which is in the form of an inverted crater, and the second interegaging formation is in the shape of a dome surrounded by a peripheral shelf so that the dome on each of said upstanding posts fits into the inverted crater and said peripheral shelf cooperates with the corresponding rim of the inverted crater.

13. The structure recited in claim 11, each of said posts having side walls formed with four outwardly projecting portions corresponding to four indentations on the underside of the side walls of said posts, the generally vertical axis of each of said projections being spaced from each other by an angle of approximately 90° and being located above a cellular bottom of generally square configuration with each side of the square arranged at an angle of approximately 45° to the side and end walls of the tray, the walls of the cells below the projections extending from the posts and adjacent the egg cell bottoms being thinner than the remainder of the walls of the egg cells.

14. The structure recited in claim 13, wherein each cell of said cellular tray has a bottom which is substantially flat on the inside and footed on the outside, said footed formation comprising a peripheral thin area, a thick portion in closed geometrical form within said peripheral area, and a thin central portion within said thick portion.

* * * * *